US009764330B2

(12) United States Patent
Ivanoff et al.

(10) Patent No.: US 9,764,330 B2
(45) Date of Patent: Sep. 19, 2017

(54) SCREENING APPARATUS

(71) Applicant: CDE Global Limited, Cookstown, County Tyrone (GB)

(72) Inventors: Enda Ivanoff, Moy (GB); Kevin Vallelly, Maghera (GB); Robert Lyttle, Dungannon (GB)

(73) Assignee: CDE Global Limited, Cookstown (GB)

( * ) Notice: Subject to any disclaimer, the term of this patent is extended or adjusted under 35 U.S.C. 154(b) by 0 days.

(21) Appl. No.: 15/015,932

(22) Filed: Feb. 4, 2016

(65) Prior Publication Data

US 2016/0228881 A1 Aug. 11, 2016

(30) Foreign Application Priority Data

Feb. 6, 2015 (GB) ..... 1501981.3

(51) Int. Cl.
*B07B 9/00* (2006.01)
*B03B 11/00* (2006.01)
(Continued)

(52) U.S. Cl.
CPC ..... *B03B 11/00* (2013.01); *B03B 5/34* (2013.01); *B03B 7/00* (2013.01); *B07B 1/28* (2013.01);
(Continued)

(58) Field of Classification Search
CPC .. B03B 7/00; B03B 1/28; B03B 13/16; B03B 5/34
(Continued)

(56) References Cited

U.S. PATENT DOCUMENTS 3,278,022 A * 10/1966 Moeschler ..... B03B 5/48 209/10
3,292,373 A * 12/1966 Tado ..... F01M 11/0004 123/196 R
(Continued)

FOREIGN PATENT DOCUMENTS

| | | |
|---|---|---|
| GB | 1572990 | 8/1980 |
| JP | 3636205 | 4/2005 |
| JP | 2007111676 | 5/2007 |

OTHER PUBLICATIONS

UK Examination Report for corresponding UK Application No. GB1501981.3, dated Jul. 17, 2015.

*Primary Examiner* — Terrell Matthews
(74) *Attorney, Agent, or Firm* — Gardner, Linn, Burkhart & Flory, LLP

(57) ABSTRACT

A screening apparatus for grading particulate material includes a grading screen having apertures for water and/or undersize particles to pass through. The grading screen is supported on a frame mounted on a chassis via resilient linkages, and the grading screen being vibrated by a vibrating device that imparts circular or reciprocating motion to the grading screen. The grading screen is set at a predetermined slope whereby material to be graded can be delivered onto an upper end while the grading screen is vibrated to convey the material over the grading screen and to cause undersize material to pass through the apertures. Oversize material is discharged from a lower end of the screen onto a conveyor or into a collection bay or hopper. A sump beneath the grading screen receives under-sized material passing through the grading screen, and a jet pump conveys material from the sump to a dewatering screen.

22 Claims, 5 Drawing Sheets

(51) Int. Cl.

| | |
|---|---|
| ***B07B 13/16*** | (2006.01) |
| ***B03B 5/34*** | (2006.01) |
| ***B03B 7/00*** | (2006.01) |
| ***B07B 1/46*** | (2006.01) |
| ***B07B 1/28*** | (2006.01) |
| *B07B 1/42* | (2006.01) |

(52) U.S. Cl.
CPC ..... *B07B 1/4609* (2013.01); *B07B 13/16* (2013.01); *B07B 1/42* (2013.01); *B07B 2230/01* (2013.01)

(58) Field of Classification Search
USPC ..... 209/12.1, 17, 18
See application file for complete search history.

(56) References Cited

U.S. PATENT DOCUMENTS 3,371,618 A * 3/1968 Chambers ..... F04F 5/467 417/163
3,606,587 A * 9/1971 Fraser ..... F04F 5/46 37/322
3,984,053 A * 10/1976 Hechler, IV ..... B05B 7/2443 239/318
4,253,943 A * 3/1981 Thrasher ..... B03B 5/04 209/437
4,364,822 A * 12/1982 Rich, Jr. ..... B03B 5/34 209/11
4,575,324 A * 3/1986 Sommer ..... F01C 21/0809 418/217
5,112,190 A * 5/1992 Kajiwara ..... F04D 29/4266 415/108
5,269,679 A * 12/1993 Syska ..... F23C 6/045 431/115
5,794,791 A * 8/1998 Kindig ..... B03B 5/34 209/12.1
7,886,913 B1 * 2/2011 Fritz ..... B03C 1/247 209/214
2006/0180507 A1 * 8/2006 DeHart ..... B01D 21/02 209/311
2010/0270216 A1 * 10/2010 Burnett ..... B01D 33/0376 209/606
2015/0231638 A1 * 8/2015 Mancuso ..... B02C 18/0084 241/43
2016/0101428 A1 * 4/2016 Convery ..... B03B 9/00 209/3

* cited by examiner

SCREENING APPARATUS

FIELD OF THE INVENTION

The present invention relates to a screening apparatus for washing and grading particulate material, such as sand. Vibrating screens are commonly used to wash, sort, grade or classify particulate material, such as sand.

BACKGROUND OF THE INVENTION

A typical vibrating screen comprises a frame, defined by a pair of substantially parallel side walls interconnected by transversely extending bridging members, upon which is mounted a polyurethane screen having small openings or slots for water and/or undersize particles to pass through.

The frame is mounted on a chassis via resilient mountings or linkages and the frame, and thus the screen, is typically vibrated by means of a pair of counter rotating rotors defining eccentric masses, typically driven by one or more drive motors, to impart circular or reciprocating vibratory motion to the screen.

In a grading screen the screen is arranged at a predetermined slope and material to be graded is delivered onto an upper end of the screen, typically entrained in a flow of water. The screen is vibrated at high frequency to convey the material over the screen and to cause undersize material (and water) to pass through the openings, oversize material being discharged from a lower end of the screen onto a conveyor or into a collection bay or hopper. The undersize material is typically collected in a sump and is then conveyed to a dewatering screen and/or cyclone separator for dewatering or further treatment.

It is known to provide a grading screen having a split screen, typically forming the bottom deck of a multi-deck screening apparatus, wherein the screen is divided into an upstream section having a relatively small aperture size and a downstream section having a larger aperture size, such that the screen can produce three separate products or grades of material. For example, the upstream section of the screen may have very small apertures where the 0-4 mm material can pass through and the downstream section may have larger apertures to allow the 4-6 mm material to pass through. The 6-25 mm product may then travel down the screen to pass over the downstream end of the screen onto a stockpiling conveyor. The sump of the screening apparatus may be corresponding split into two sections for receiving material from the upstream and downstream sections of the screen respectively. Typically the 0-4 mm material collected in a first section of the sump may be pumped to a cyclone separator, typically by means of a centrifugal pump, for removal of fine contaminants from the fine product, before being passed to a dewatering screen while the 4-6 mm product may be pumped directly to the dewatering screen (which may also be split into two sections to maintain the separation of the 0-4 mm and 4-6 mm products). However, the 4-6 mm product in particular tends to be very gritty and thus leads to accelerated wear of the pump used to pass such material to the dewatering screen. Different aperture sizes may be used to suit different particle sizes to provide desired grades of product (e.g. 0-2 mm, 2-8 mm and 8-25 mm).

An object of the present invention is to provide an improved screening apparatus that overcomes the problems of the prior art.

SUMMARY OF THE INVENTION

According to a first aspect of the present invention there is provided a screening apparatus for grading particulate material comprising a grading screen having apertures formed therein for water and/or undersize particles to pass through, the grading screen being supported on a frame mounted on a chassis via resilient linkages, the frame, and thus the grading screen being vibrated by vibrating means, such as a pair of counter rotating rotors defining eccentric masses driven by one or more drive motors, to impart circular or reciprocating vibratory motion to the grading screen, the grading screen being arranged at a predetermined slope whereby material to be graded can be delivered onto an upper end of the grading screen, typically entrained in a flow of water, while the grading screen is vibrated by the vibrating means to convey the material over the grading screen and to cause undersize material and water to pass through the apertures of the grading screen, oversize material being discharged from a lower end of the grading screen onto a conveyor or into a collection bay or hopper, a sump being provided beneath the grading screen for receiving under-sized material passing through the openings of the grading screen, a jet pump being provided for conveying material from the sump to a dewatering screen.

The jet pump may entrain material from the sump into a high pressure stream of water.

Optionally, the jet pump is mounted on an outer wall of the sump, material being entrained into the jet pump via an opening in the outer wall of the sump. A suction chamber of the jet pump communicates with the sump via a feed passage. The feed passage preferably narrows from an opening in the outer wall of the sump towards the suction chamber of the jet pump.

A water inlet may be provided at an upstream end of the jet pump connectable to a high pressure water supply of the apparatus, the water inlet communicating with a converging venturi section terminating in an outlet nozzle for supplying high pressure water into the suction chamber of the jet pump.

In one embodiment the outlet nozzle comprises a replaceable and interchangeable nozzle insert mounted within the venturi section of the jet pump, whereby nozzle inserts having different internal bores can be inserted within the venturi section of the jet pump to provide a desired water velocity within the suction chamber of the jet pump. Optionally, a replaceable wear liner is be provided within the suction chamber. The replaceable wear liner may be formed from cast iron. Optionally, the replaceable wear liner is formed from a hard wearing material, such as high strength high chromium cast iron.

Optionally, the jet pump includes a mixing section downstream of the suction chamber, the mixing section having substantially parallel side walls. An upstream end of the mixing section may be provided with a radiused or rounded edge. Optionally, the jet pump includes a diverging diffuser section downstream of the mixing section. The mixing section and/or diffuser section may be replaceable. The mixing section and/or diffuser section may be formed from a hard wearing material, such as a high chromium cast iron.

In one embodiment the grading screen comprises a split screen divided into an upstream section having a relatively small aperture size and a downstream section having a larger aperture size, undersized material passing through the apertures of the downstream section being collected in a separate region of the sump for easier maintenance, the jet pump being arranged to pass the undersized material from the separate sump region to the dewatering screen. The jet pump may be mounted on a wall of the separate region of the sump outside of the sump. The separate region of the sump comprises may comprise an auxiliary sump mounted within the sump of the grading screen. The under-sized material passing through the apertures of the upstream section of the grading screen may be received in a main sump region, a pump being provided for pumping material from the main sump region to a hydrocyclone. The pump may comprise a centrifugal pump. The underflow from the hydrocyclone is preferably delivered to the dewatering screen.

Optionally, the dewatering screen is split in a first section which receives material from the separate sump region via the jet pump and a second section which receives the underflow of the hydrocyclone.

These and other objects, advantages and features of the invention will become apparent upon review of the following specification in conjunction with the drawings.

BRIEF DESCRIPTION OF THE DRAWINGS

A screening apparatus in accordance with an embodiment of the present invention will now be described, by way of example only, with reference to the accompanying drawings, in which.

DETAILED DESCRIPTION OF THE DRAWINGS

Figure 1:
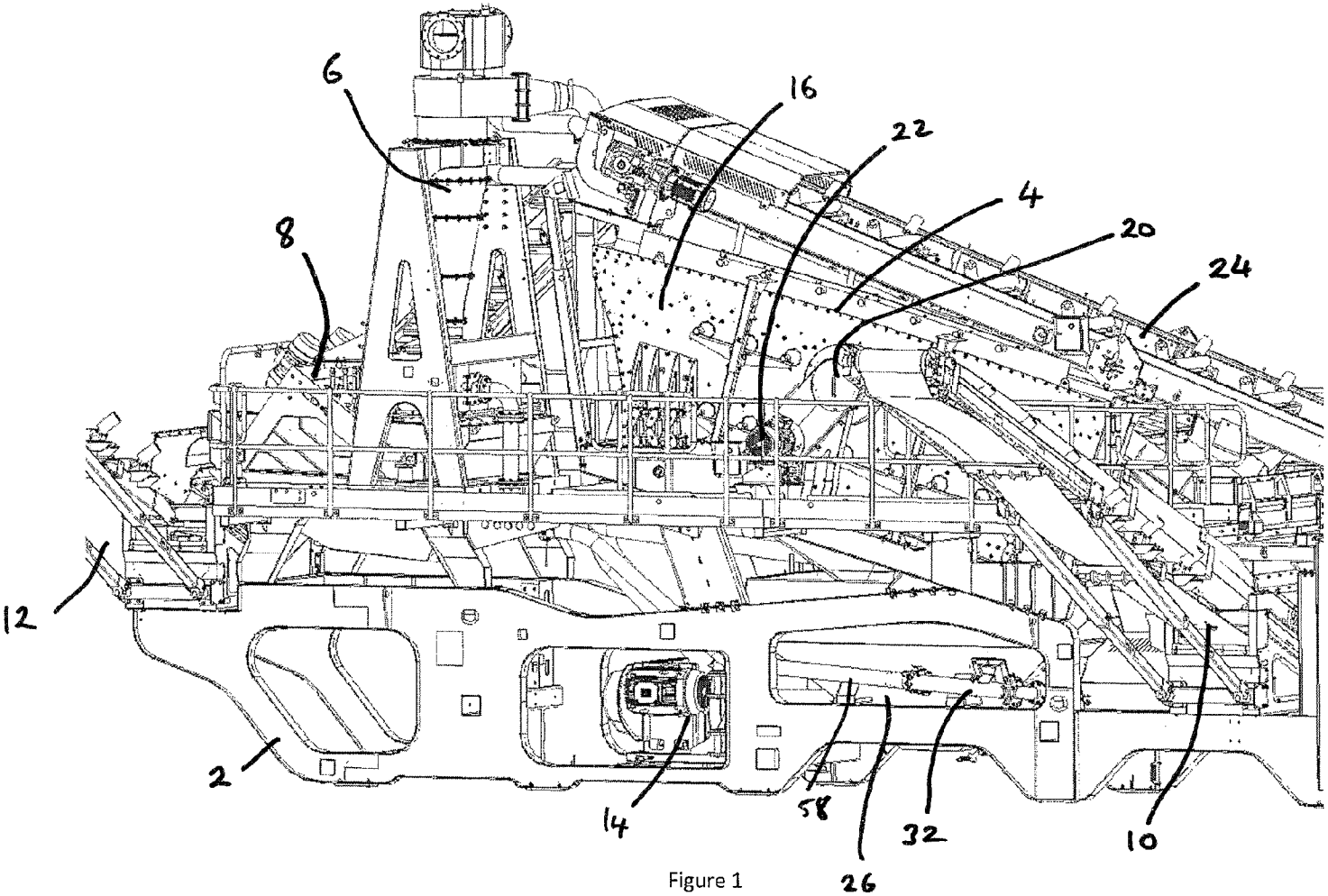
FIG. 1 is a perspective view of a screening apparatus in accordance with an embodiment of the present invention.
Figure 2:
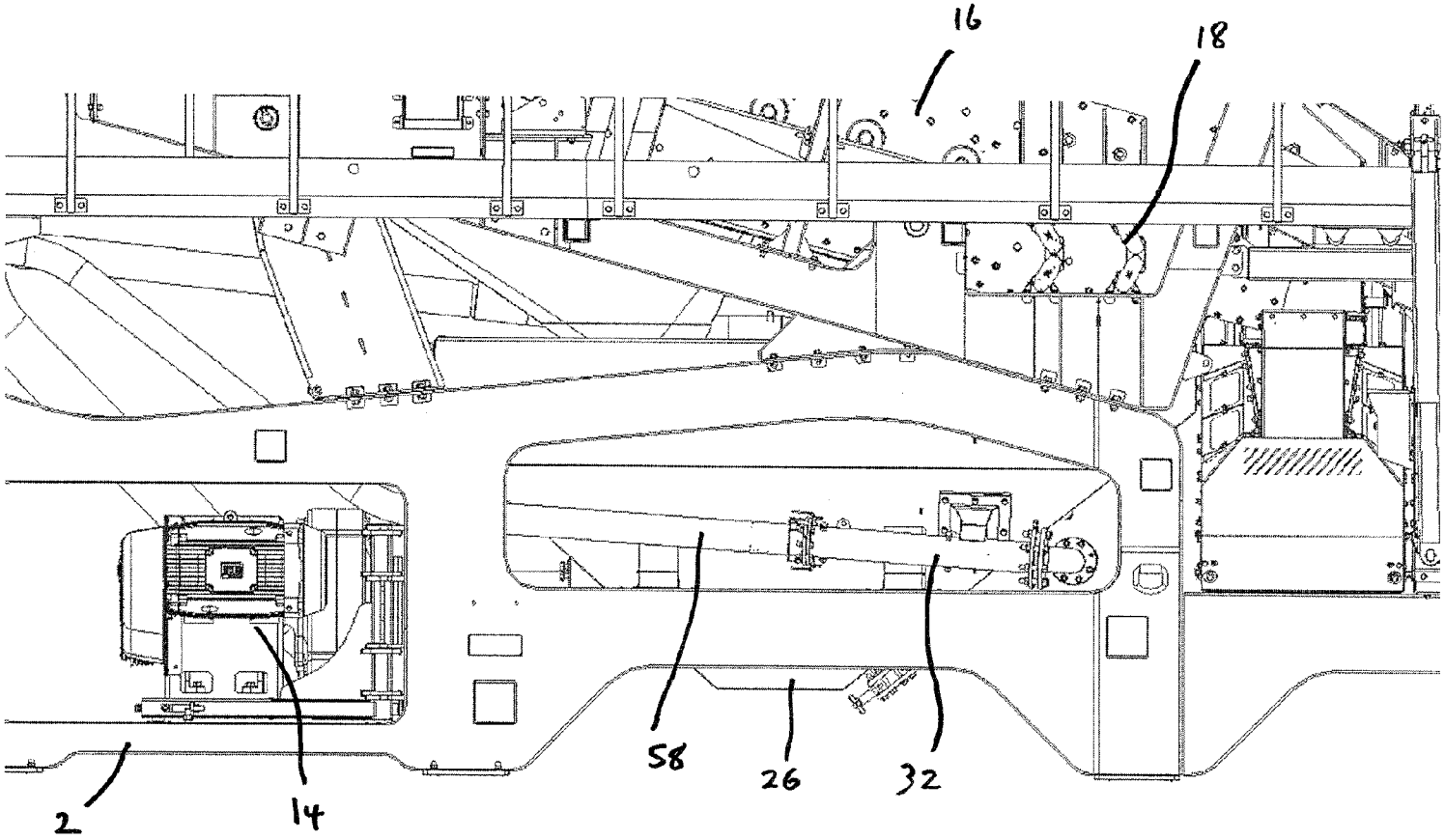
FIG. 2 is an enlarged side view of a portion of the screening apparatus of FIG. 1.
Figure 3:
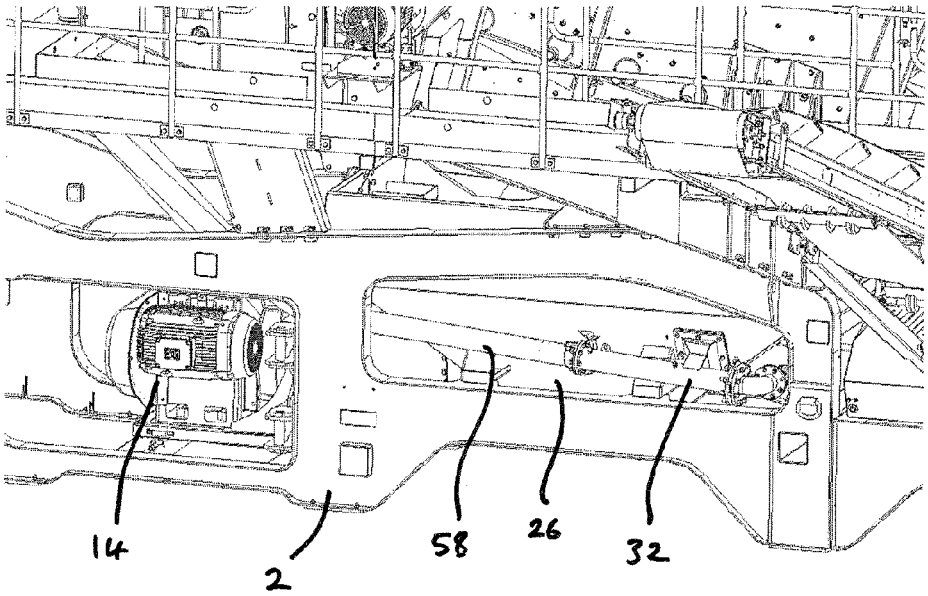
FIG. 3 is a perspective view of a portion of the screening apparatus generally corresponding to FIG. 2.

A screening apparatus in accordance with an embodiment of the present invention is illustrated in FIG. 1. The apparatus comprises an elongate chassis 2 upon which is mounted a grading screen 4, a hydrocyclone 6 and a dewatering screen 8 and various stockpile conveyors 10,12, pumps 14 and control devices.

As is conventional in the art, the grading screen 4, typically comprises the lower deck of a multi-deck screening assembly, comprises a frame 16, for example defined by a pair of substantially parallel side walls interconnected by transversely extending bridging members, upon which is mounted a polyurethane screen deck having small openings or slots for water and/or undersize particles to pass through.

The frame 16 of the grading screen 4 is mounted on a chassis 2 via resilient mountings or linkages 18 and the frame, and thus the screen, is typically vibrated by means of one or more eccentric masses 20 driven by one or more drive motors 22, to impart circular or reciprocating vibratory motion to the screen deck.

The grading screen 4 is arranged at a predetermined slope and material to be graded is delivered onto an upper end of the screen via a feed conveyor 24, entrained in a flow of water added to the material at the upper end of the screen deck via a suitable supply means. The grading screen 4 can be vibrated at high frequency to convey the material over the screen and to cause undersize material (and water) to pass through the openings, oversize material being discharged from a lower end of the screen deck onto a belt conveyor 10.

The grading screen 4 comprises a split screen, wherein the screen deck is divided into an upstream section having a relatively small aperture size and a downstream section having a larger aperture size, such that the screen deck can produce three or more separate products or grades of material. For example, the upstream section of the grading screen 4 may have very small apertures where the 0-4 mm material can pass through and the downstream section may have larger apertures to allow the 4-6 mm material to pass through. The +6 mm product may then travels down the screen deck to pass over the downstream end of the screen onto the belt conveyor 10 extending from one side of the chassis.

Figure 4:
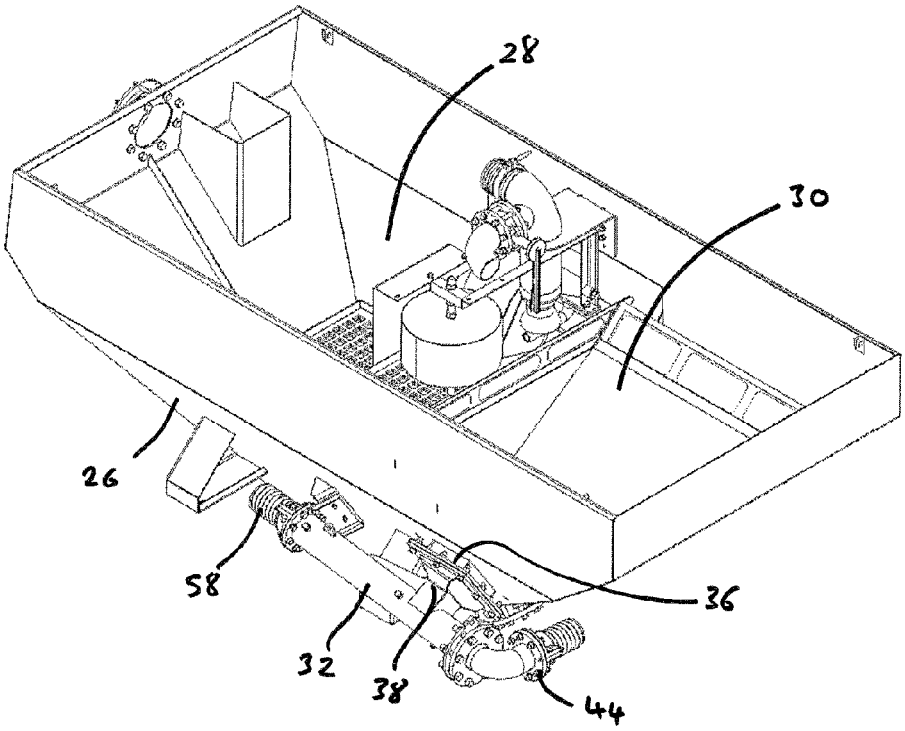
FIG. 4 is a top perspective view of part of the screening apparatus of FIG. 1.
Figure 5:
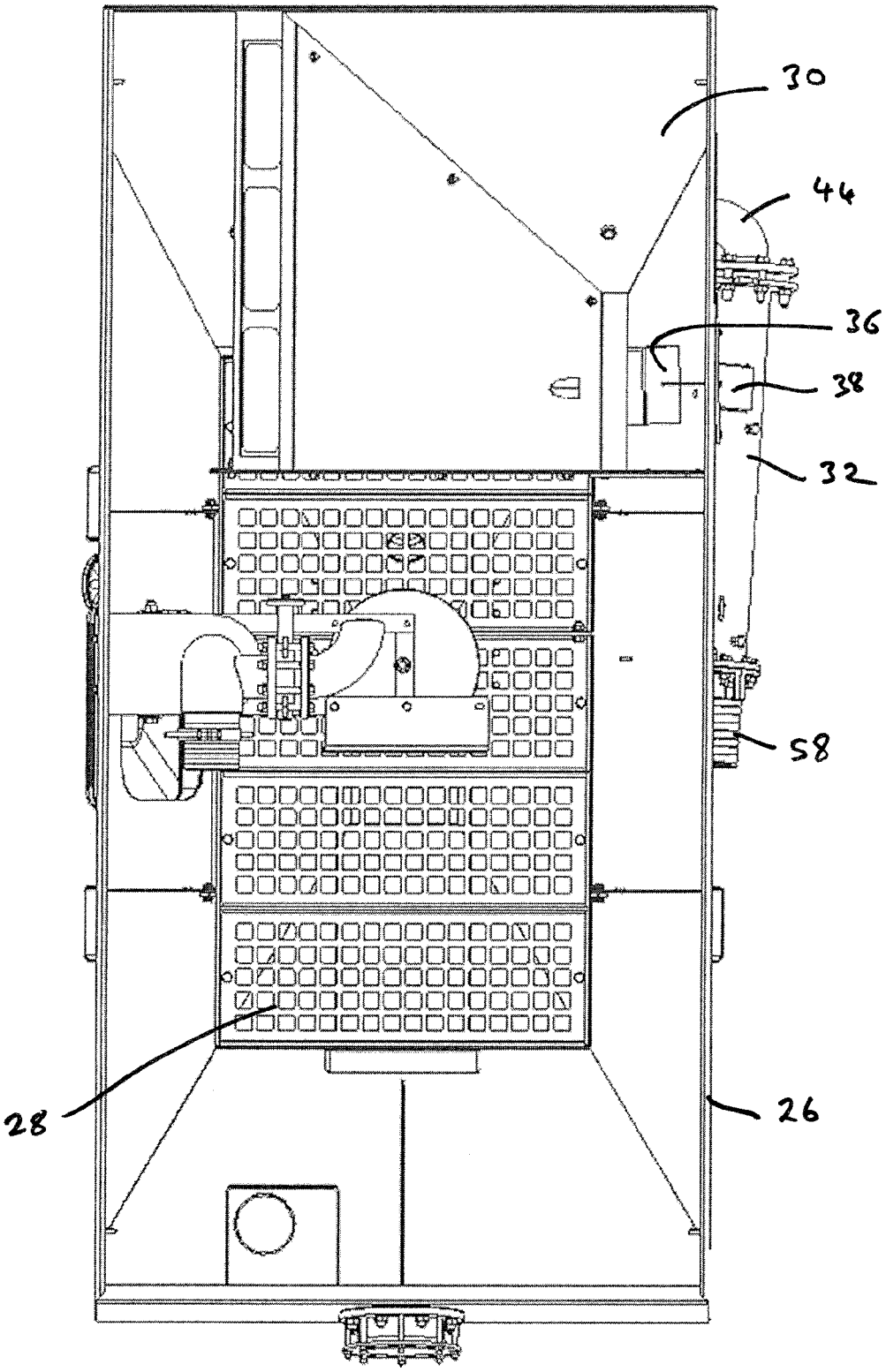
FIG. 5 is a top plan view of the part of the screening apparatus of FIG. 4.
Figure 6:
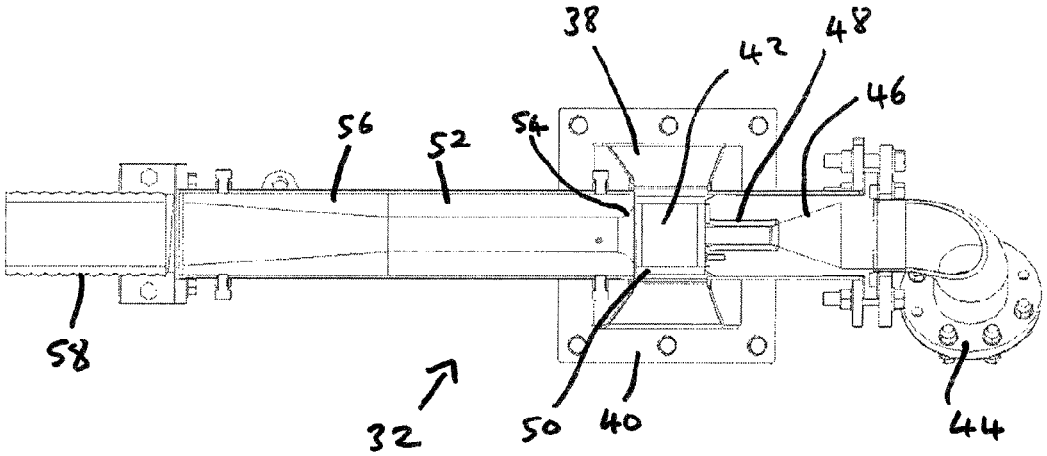
FIG. 6 is a sectional view of a jet pump of the screening apparatus of FIG. 1.
Figure 7:
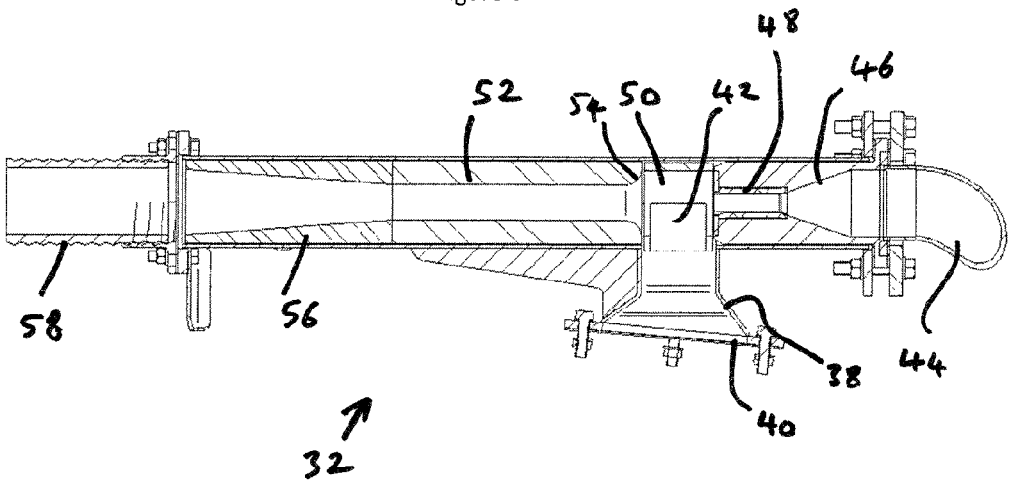
FIG. 7 is a further sectional view of the jet pump of FIG. 6.

As best shown in FIGS. 4 and 5, the sump 26 of the grading screen 4 comprises a primary chamber 28 for receiving the 0-4 mm material from the upstream section of the screen deck. A smaller auxiliary sump 30 is mounted within the sump 26 of the grading screen 4, the auxiliary sump 30 being arranged to receive the 4-6 mm material from the downstream section of the screen deck of the grading screen 4.

The 0-4 mm material collected in the primary chamber 28 of the sump 26 is pumped to the hydrocyclone 6 by means of a centrifugal pump 14. The hydrocyclone 6 facilitates highly accurate separation of silts and clays from the final washed sand product. The fine sand fraction is then discharged via the cyclone underflow to a rubber lined feed box which distributes the material evenly onto a first side of the dewatering screen 8. This maximises the screening area and ensures high efficiency dewatering. This product is then stockpiled from a discharge end of the dewatering screen 8 via a stockpile belt conveyor.

The <63 micron fraction overflow from the hydrocyclone 6 and is transferred along with waste water for further processing. This overflow is discharged at the highest point of the apparatus which negates the need for additional pumping. Such overflow from the hydrocyclone 6 may be fed to a thickener tank (not shown), where a flocculent is added. Sludge settles at the bottom of the thickener tank, where a set of rakes may ensure that the sludge is maintained at an even consistency before it is discharged to ponds. Clean water overflows the thickener tank and can be recycled to a water storage tank for reuse in the apparatus.

The 4-6 mm product collected in the auxiliary sump 30 is transferred to a second side of the dewatering screen 8 by means of a jet pump 32 mounted on a side wall 34 of the auxiliary sump 30 on an outer side thereof, whereby the jet pump 32 is readily accessible for maintenance and repair.

The sizes of the apertures in the upstream and downstream sections of the screen deck may be varied to suit the particle size range (or cut point) of the products to be produced by the screening apparatus. Thus the size ranges listed above are only examples of possible size ranges.

An opening 36 is defined in the side wall 34 of the auxiliary sump 30, adjacent a lower end thereof to which the jet pump 32 is attached. A feed section 38 of the jet pump 32 comprises a peripheral mounting flange 40 adapted to engage the periphery of the opening 36 auxiliary sump 30, the feed section 40 narrowing from the mounting flange 40 towards a suction chamber 42 of the jet pump 32. A water inlet 44 is provided at an upstream end of the jet pump 32 connectable to a high pressure water supply of the apparatus. The water inlet 44 communicates with a converging venturi 46 section leading to a nozzle 48. The nozzle 48 comprises a replaceable insert, whereby nozzles 48 having different internal bores can be used to provide a desired 20 water velocity within the suction chamber 42 of the jet pump 32.

A replaceable wear liner 50, formed from a hard wearing material, such as a high chromium cast iron, may be provided within the suction chamber 42.

Immediately downstream of the suction chamber 42 a mixing section 52 is provided having substantially parallel side walls. An upstream end of the mixing section 52 is provided with a radiused or rounded edge 54. A diverging diffuser section 56 is provided downstream of the mixing section 52. The mixing section 52 and/or diffuser sections 54 may also be arranged to be replaceable and may be formed from a suitable hard wearing material, such as a high chromium cast iron. An outlet pipe 58 is coupled to the downstream end of the jet pump 32 leading to a feed box of the dewatering screen 8.

By providing an interchangeable and replaceable nozzle 48, suction chamber wear liner 52 and interchangeable and replaceable mixing and diffuser sections 52,54, the jet pump can be tailored to suit the material being pumped and can be repaired when worn, facilitated by the accessibility of the jet pump external to the sump 26 of the grading screen 4.

The invention is not limited to the embodiment(s) described herein but can be amended or modified without departing from the scope of the present invention, which is intended to be limited only by the scope of the appended claims as interpreted according to the principles of patent law including the doctrine of equivalents.

The invention claimed is:

1. A screening apparatus for grading particulate material, comprising:

a grading screen having apertures formed therein for water and/or undersize particles to pass through, the grading screen being supported on a frame mounted on a chassis via resilient linkages;

a vibrating device operable to vibrate the frame and the grading screen;

wherein the grading screen is arranged at a predetermined slope whereby material to be graded can be delivered onto an upper end of the grading screen while the grading screen is vibrated by the vibrating device to convey the material over the grading screen and to thereby cause undersize material to pass through the apertures of the grading screen, wherein the grading screen is operable to discharge oversize material from a lower end thereof onto a conveyor or into a collection bay or hopper;

a sump mounted beneath the grading screen for receiving under-sized material passing through the openings of the grading screen; and a jet pump in fluid communication with the sump for conveying the under-sized material from the sump to a dewatering screen;

wherein the grading screen comprises a split screen divided into an upstream section having a relatively small aperture size and a downstream section having a relatively larger aperture size, wherein the grading screen is configured so that undersized material passing through the apertures of the downstream section is collected in a separate region of the sump, and wherein the jet pump is configured to pass the undersized material from the separate sump region to the dewatering screen; and wherein under-sized material passing through the apertures of the upstream section of the grading screen are received in a main sump region, and wherein the apparatus comprises a further pump for pumping material from the main sump region to a hydrocyclone.

2. The apparatus of claim 1, wherein the jet pump is operable to entrain material from the sump into a high pressure stream of water.

3. The apparatus of claim 1, wherein the jet pump is mounted on an outer wall of the sump.

4. The apparatus of claim 3, wherein the jet pump comprises a suction chamber in communication with the sump via a feed passage, material being entrained into the jet pump via an opening in the outer wall of the sump.

5. The apparatus of claim 4, wherein the feed passage narrows from the outer wall of the sump towards the suction chamber of the jet pump.

6. The apparatus of claim 4, wherein a water inlet is provided at an upstream end of the jet pump, wherein the water inlet is connectable to a high pressure water supply of the apparatus, the water inlet communicating with a converging venturi section terminating in an outlet nozzle for supplying high pressure water into the suction chamber of the jet pump.

7. The apparatus of claim 6, wherein the outlet nozzle comprises a replaceable and interchangeable nozzle insert mounted within the venturi section of the jet pump, whereby a plurality of the nozzle inserts having different internal bores can be inserted within the venturi section of the jet pump to provide a desired water velocity within the suction chamber of the jet pump.

8. The apparatus of claim 4, further comprising a replaceable wear liner provided within the suction chamber.

9. The apparatus of claim 8, wherein the replaceable wear liner is formed from cast iron.

10. The apparatus of claim 9, wherein the replaceable wear liner is formed from high chromium cast iron.

11. The apparatus of claim 4, wherein the jet pump includes a mixing section downstream of the suction chamber, the mixing section having substantially parallel side walls.

12. The apparatus of claim 11, wherein an upstream end of the mixing section is provided with a radiused or rounded edge.

13. The apparatus of claim 11, wherein the jet pump includes a diverging diffuser section downstream of the mixing section.

14. The apparatus of claim 13, wherein the mixing section and/or diffuser section are replaceable.

15. The apparatus of claim 13, wherein the mixing section and/or diffuser section are formed from a high chromium cast iron.

16. The apparatus of claim 1, wherein the jet pump is mounted on a wall of the separate region of the sump outside of the sump.

17. The apparatus of claim 16, wherein the separate region of the sump comprises an auxiliary sump mounted within the sump of the grading screen.

18. The apparatus of claim 1, wherein the further pump comprises a centrifugal pump.

19. The apparatus of claim 1, wherein an underflow from the hydrocyclone is delivered to the dewatering screen.

20. The apparatus of claim 1, wherein the dewatering screen is split in a first section which receives material from the separate sump region via the jet pump and a second section which receives an underflow of the hydrocyclone.

21. The apparatus of claim 1, wherein the apparatus comprises a multi-deck screening apparatus and the grading screen comprises a lower deck of the multideck screening apparatus.

22. A screening apparatus for grading particulate material, comprising:

a grading screen having apertures formed therein for water and/or undersize particles to pass through, the grading screen being supported on a frame mounted on a chassis via resilient linkages;

a vibrating device operable to vibrate the frame and the grading screen;

wherein the grading screen is arranged at a predetermined slope whereby material to be graded can be delivered onto an upper end of the grading screen while the grading screen is vibrated by the vibrating device to convey the material over the grading screen and to thereby cause undersize material to pass through the apertures of the grading screen, wherein the grading screen is operable to discharge oversize material from a lower end thereof onto a conveyor or into a collection bay or hopper;

a hydrocyclone operable to dispense an underflow to the grading screen;

a sump mounted beneath the grading screen for receiving under-sized material passing through the openings of the grading screen; and a jet pump in fluid communication with the sump for conveying the under-sized material from the sump to a dewatering screen;

wherein the grading screen is configured so that under-sized material passing through the apertures of a downstream section is collected in a separate region of the sump, and wherein the jet pump is configured to pass the undersized material from the separate sump region to the dewatering screen; and wherein the dewatering screen is split in a first section which receives material from the separate sump region via the jet pump and a second section which receives the underflow of the hydrocyclone.

* * * * *